United States Patent [19]

Bevan

[11] 4,020,015

[45] Apr. 26, 1977

[54] DETERGENT COMPOSITIONS

[75] Inventor: Geoffrey Bevan, Wirral, England

[73] Assignee: Lever Brothers Company, New York, N.Y.

[22] Filed: Nov. 14, 1975

[21] Appl. No.: 632,040

Related U.S. Application Data

[63] Continuation of Ser. No. 350,262, April 11, 1973, abandoned.

[30] Foreign Application Priority Data

Oct. 12, 1971 United Kingdom ..... 47397/71

[52] U.S. Cl. ..... 252/544; 252/89 R; 252/134; 252/174; 252/DIG. 2; 252/DIG. 15

[51] Int. Cl.[2] ..... C11D 3/37; C11D 17/00

[58] Field of Search ..... 252/89, 134, 174, DIG. 2, 252/DIG. 15, 544

[56] References Cited

UNITED STATES PATENTS

| | | | |
|---|---|---|---|
| 3,144,412 | 8/1964 | Inamorato | 252/DIG. 2 X |
| 3,668,000 | 6/1972 | Forschirm et al. | 252/DIG. 2 X |

FOREIGN PATENTS OR APPLICATIONS

| | | |
|---|---|---|
| 1,088,984 | 10/1967 | United Kingdom |
| 1,124,271 | 8/1968 | United Kingdom |
| 1,154,730 | 6/1969 | United Kingdom |
| 1,204,123 | 9/1970 | United Kingdom |

*Primary Examiner*—Harris A. Pitlick

*Attorney, Agent, or Firm*—James J. Farrell; Melvin H. Kurtz; Kenneth F. Dusyn

[57] ABSTRACT

The invention provides a process by which certain soil-release agents are given enhanced activity in detergent compositions by incorporating them in the composition in granules of a carrier, particularly an organic extrudable solid, throughout which the soil-release agent is uniformly dispersed.

3 Claims, No Drawings

DETERGENT COMPOSITIONS

This is a continuation of application Ser. no. 350,262 filed Apr. 11, 1973 and now abandoned.

The invention relates to a detergent composition and its preparation.

BACKGROUND TO THE INVENTION AND PRIOR ART

UK Pat. specification No. 1,204,123 (Unilever) discloses and claims detergent compositions and a process for their preparation in which sensitive ingredients are incorporated in granules throughout each of which the sensitive ingredient is dispersed. It has now been found that this and similar techniques are particularly advantageous with anti-redeposition agents.

Anti-redeposition agents are known ingredients in washing compositions. Reference can be made to Schwartz et al., Surface Active Agents and Detergents, Vol. II, Interscience Publishers Inc., N.Y., 1958, particularly pages 302–307. As there explained, anti-redeposition agents act to reduce the tendency for soil suspended in the wash-liquor to deposit on wash articles. Such anti-redeposition agents are usually polymers containing hydrophilic groups. Examples, see also Schwartz et al. cited above, include sodium carboxymethyl cellulose, polyvinyl pyrrolidone, polyvinyl alcohols, partially hydrolysed polyvinyl acetates and alginates.

Within the last few years classes of anti-redeposition agents have been found that have a special, additional function: once deposited on clothes made from a fibre they reduce somewhat the tendency of the clothes to soil and they ease the removal in a subsequent wash of any soiling, particularly oily soiling, that does occur. They are soild release agents as well as anti-redeposition agents.

Such a soil-release agent is usually, but not necessarily, a polycondensate containing a hydrophilic group and a hydrophobic repeating group. The hydrophobic repeating group is preferably one that occurs in a fibre used to make clothes. Preferred soil-release agents are the agents developed by I.C.I. Ltd. of which some are sold under the trade-name Permalose. The preparation, structure, properties and uses of these preferred agents are described in U.K. Pat. specifications Nos. 1,088,984, 1,108,811, 1,108,812, 1,124,271, and 1,154,730 and Netherlands Pat. application No. 6614134 (all I.C.I.).

Another preferred class of compounds that has been found to have soil-release properties as well as anti-redeposition properties is celluloses containing an etherlinked, unsubstituted short-chain (e.g. $C_1$ to $C_4$) alkyl group and preferably also an ether-linked substituent based on a short-chain (e.g. $C_2$ to $C_4$) hydroxy alkyl group. Preferred examples of such compounds are described in Netherlands Pat. application Ser. No. 7110635 (Unilever) and U.S. Pat. No. 3,668,000 (Celanese Corporation). They are soil-release agents for synthetic materials. It will be appreciated that the ether-linked substituent based on a short-chain hydroxy alkyl group, as for example in Netherlands Pat. No. 7110635 or U.S. Pat. No. 3,668,000, can be a polymer formed, for instance, by condensing ethylene oxide or propylene oxide with the cellulose.

The preferred compound of U.S. Pat. No. 3,668,000 is hydroxy propyl methyl cellulose as there described.

The preferred compounds of Netherlands Pat. No. 7110635 are, as there described, celluloses in which the total number of substituent groups per glucose unit of a cellulose derivative should be between about 1.5 and about 3.0, preferably between about 2.0 and about 3.0. There should be at least about 1.0, preferably from about 1.0 to about 2.5, and particularly preferably from about 1.5 to about 2.1, alkyl groups per glucose unit; and at least about 0.1, preferably from about 0.2 to about 1.5, and particularly preferably from about 0.5 to about 1.5, hydroxyalkyl groups per glucose unit. The alkyl groups should contain from 1 to 4, and preferably from 1 to 3, carbon atoms, and the hydroxyalkyl groups should contain from 2 to 4, preferably from 2 to 3, carbon atoms. Particularly preferred alkyl groups are methyl and ethyl, and the preferred hydroxyalkyl groups are hydroxyethyl and hydroxypropyl. Propyl, butyl and hydroxybutyl groups may also be used. When the alkyl group is methyl it is preferred that the hydroxyalkyl group be hydroxypropyl, and when the alkyl group is ethyl it is preferred that the hydroxyalkyl group be hydroxyethyl, although it will be appreciated that other combinations of alkyl and hydroxyalkyl groups may be used if desired. Particularly preferred cellulose derivatives for use in accordance with the invention are methyl hydroxypropyl celluloses having from 1.7 to 2.1 methyl groups per glucose unit and from 0.8 to 1.0 hydroxypropyl groups per glucose unit, and ethyl hydroxyethyl celluloses having from 1.5 to 1.6 ethyl groups per glucose unit and from 0.5 to 0.6 hyroxyethyl groups per glucose unit.

Many of these cellulose derivatives are available commercially, and others can readily be prepared by simple chemical procedures. For instance, a methyl hydroxypropyl cellulose derivative can be prepared by reacting the cellulose with dimethylsulphate and then with propylene oxide (or vice versa: if one substituent is to be present in a greater amount than the other, it is preferable that the major substituent is applied first), and an ethyl hydroxyethyl cellulose can be prepared by reacting the cellulose with ethylene oxide and then with ethyl chloride.

The Kernel of the Invention

It has now been found that use of techniques for incorporating sensitive ingredients, for example the technique described in UK Pat. specification No. 1,204,123, improve remarkably the soil-release effect of certain soil-release agents.

The invention therefore provides a process for improving a detergent composition containing a soil-release agent in which the soil-release agent is incorporated in the detergent composition as granules made by mixing the soil-release agent, said soil-release agent being a. a copolymer, in the range of 1:2 to 1:10, of polyoxyethylene glycol and polyethylene terephthalate;

b. a copolymer of (*i*) polyoxyethylene glycol, (*ii*) dicarboxylic acids, preferably adipic acid and (*iii*) a cycloaliphatic lactam, preferably caprolactam, or aliphatic diamines, preferably hexamethylene diamine, or salts thereof with a dicarboxylic acid, preferably adipic acid; or c. a cellulose containing an ether-linked, unsubstituted $C_1$ to $C_4$ alkyl group and an ether-linked substituent based on a $C_2$ to $C_4$ hydroxy alkyl group in which the total number of substituent groups per glucose unit of the cellulose is between 1.5 and 3.0, thoroughly with a water-soluble, detergent-compatible carrier to form granules throughout each of which said soil-release agent is uniformly dispersed.

Further Exposition of the Invention

In general any techniques for forming the granules can be used. Preferably the mixture is mechanically worked to ensure that the anti-redeposition agent is distributed uniformly throughout each granule. Techniques are indicated in, for example, UK Pat. specifications Nos. 1,204,123 and 1,237,899.

Preferably the carrier is an organic extrudable solid. In this case the granules are preferably formed by extrusion of the mixture of the anti-redeposition agent and the organic extrudable solid through narrow holes. The mixture is preferably milled as in soap-technology before extrusion. It will be appreciated that any water-soluble detergent-compatible organic extrudable solid can be used.

By extrudable solid is means a solid that is extrudable at temperatures and pressures at which the adjunct does not decompose.

Examples of suitable organic, extrudable solids are polyglycols; polyalkylene oxides; $C_{12}$–$C_{20}$ alpha-olefin sulphonates, the products obtained by the sulphonation with $SO_3$ of alpha-olefins; sodium N-coconut-acid-N-methyl taurate; condensates between polyethylene oxide and polypropylene oxide, nonionic surfactants; and condensates between polyethylene oxide and polypropylene oxide; and condensates of alkylene oxides, particularly ethylene oxide, with alcohols, alkyl phenols, amides, amines and acids.

A particularly preferred organic extrudable solid is a sodium salt of a $C_8$–$C_{22}$ fatty acid. The fatty acid may be branched or straight chain. If the fatty acid is branched a preferred range of compounds contain more than 70% of alpha-methyl carboxylic acids. Branched acids often have improved solubility characteristics. Alpha-methyl carboxylic acids have improved biodegradability over random branched-chain carboxylic acids.

Further examples of suitable organic, extrudable solids are organic substances which absorb moisture and swell, so-called swelling agents such as starches (corn and potato starches), gelatinised starch, gelatin and cellulose derivatives.

When high, 20–40%, levels of the anti-redeposition agent in the noodle are used, preferred organic extrudable solids are soap, particularly from an 80:20 mix of tallow and coconut oil, disodium $\alpha$-sulphostearate, $C_{14-18}$ $\alpha$-olefin sulphonate and coconut monoethanolamide.

U.S. Pat. No. Re. 27,214 (Fuji Denki Kogyo Kabushiki Kaisha) describes an apparatus and process by which granules can be formed in a preferred manner. The granules are made in a spherical form from, for example, either an extrudate or a simple mixture of the ingredients by being contained in a smooth-walled vessel with a rapidly rotating base. The base is preferably roughened by, for example, grooving or sand-blasting. The base is preferably rotated at a speed of 200 to 2000 revolutions per minute. The spherical granules perferably have a diameter from 0.3 to 3.0 mm.

In general granules according to the invention weight between 0.05 and 100 mg, preferably between 2 and 20 mg and have a maximum dimension of less than 15 mm, preferably less than 5 mm.

In U.K. Pat. specification No. 1,204,123 a sensitive adjunct is stated to be "an adjunct for the composition, which adjunct improves the brightening activity, detergency, germicidal activity, anti-tarnishing activity or odour of the composition and whose effectiveness is impaired when incorporated in the surfactant-containing detergent powder directly." Anti-redeposition agents suffer from one or more of the following disadvantages when incorporated directly.

a. in the product in the presence of moisture or in the slurry prior to usual spray-drying, hydrolysis or other chemical reaction occurs; and
b. inadequate dispersion of the anti-redeposition agent in the wash-liquor occurs.

Anti-redeposition agents thus are sensitive ingredients in the sense this term is used in U.K. Pat. specification No. 1,204,123.

Although the invention is applicable to all anti-redeposition agents a special and important feature of the invention as explained above is its application to anti-redeposition agents that are also soil-release agents. It has been found that the invention provides a surprising improvement with soil-release agents; soil-release has been found to be more sensitive to ill-effects of direct addition of the agent than is anti-redeposition.

The following slightly modified extract from Netherlands Pat. application No. 6614134 (I.C.I.) will illustrate the scope and preferred forms of anti-redeposition agents that are also soil-release agents. There are described "aqueous compositions comprising, in addition to a detergent, a polycondensate containing ester repeating groups and/or amide repeating groups and also at least one hydrophilic group, suitable hydrophilic groups being acidic groups, salts of acidic groups and water-solvatable polymeric groups as hereinafter defined.

Acidic groups and their salts which may function as the hydrophilic group or groups in the polycondensates used include both simple and polymeric acidic groups and their salts, and they may be present in the polycondensate molecule as end-groups or they may be attached to other groups at more than one position. The acidic groups or salts thereof may be relatively weak acids or salts thereof, such as carboxylic acids or carboxylic acid salts, or they may be relatively strong acids or salts thereof, such as sulphonic or phosphoric acids or salts of such acids. As examples of simple or monomeric acidic groups which may be present in the polycondensate molecule there may be mentioned acidic end-groups such as p-sulphobenzoic ester groups and acidic difunctional groups such as 5-sulphoisophthalic ester groups. As an example of polymeric acidic groups there may be mentioned poly(ethylene-5-isophthalate) groups.

Water-solvatable polymeric groups which may function as the hydrophilic group or groups in the polycondensates used are polymeric groups derived from water-soluble polymers having an average molecular weight of at least 100. Examples of water-solvatable polymeric groups are groups derived from poly(vinylalcohol), poly(vinyl methyl ether), poly (N,N-dimethylacrylamide), methyl cellulose, hydroxyethyl cellulose and water-soluble poly(oxyalkylene) glycols.

The polycondensates which are preferred are those in which the hydrophilic group or groups are polyoxyalkylene groups. Suitable polyoxyalkylene groups include polyoxyethylene, polyoxypropylene, polyoxytrimethylene, polyoxytetramethylene and polyoxybutylene and copolymers thereof. Particularly preferred polycondensates are those containing polyoxyethylene groups.

The hydrophilic groups present in the polycondensates can all be of the same type or they may be of different types. Thus, for example, the polycondensate can contain both acidic active groups and water-solvatable polymeric groups; furthermore, the acidic groups can be of more than one species, for instance both sulphonic acid and phosphoric acid groups can be present, and similarly the water-solvatable polymeric groups can be of more than one species, such as both polyoxyethylene and polyoxypropylene groups.

The polycondensates used can be obtained from the appropriate starting materials by any of the known methods for preparing condensation polymers. As already stated, the polycondensates are of the type in which the "repeating groups are ester groups and/or amide groups". Polycondensates containing ester repeating groups may be obtained, for example, by condensing together dihydric alcohols with dicarboxylic acids or with suitable derivatives of such acids, for example the lower alkyl esters. Polycondensates containing amide repeating groups may be obtained, for example, by self-condensation of a lactam, or by condensation of a dicarboxylic acid with a diamine or an amino-acid or lactam. Polycondensates containing both ester repeating groups and amide repeating groups may be obtained by condensation of appropriate mixtures of these starting materials. The active groups may be introduced into the polycondensates during the course of the main condensation reaction; this may be achieved by utilising as starting materials compounds containing the desired active groups in addition to the ester- or amide-forming functional groups referred to above. Thus, for example, sulphonic acid active groups may be introduced into a polycondensate containing either ester or amide groups by using as one of the starting materials a sulphocarboxylic acid, and polyoxyalkylene groups may be introduced by using as one of the starting materials a polyoxyalkylene compound having one or more hydroxyl end groups or one or more amino end-groups. Alternatively, the active groups may be introduced into the polycondensates in a second step following the main condensation reaction; for example, a simple polyamide may be reacted with an alkylene oxide to produce polyoxyalkylene groups attached to the main polymer chain. Condensation of the starting materials referred to above may be affected under the conditions well known for carrying out such reactions. Thus the starting materials may conveniently be mixed and heated, for example within the range 150° to 300° C for a period of from 30 minutes to 12 hours. It may be advantageous to carry out the condensation in an atmosphere of an inert gas such as nitrogen, or it may in some cases be preferable to incorporate a solvent or flux in the reaction mixture. Catalysts for the condensation reaction may be incorporated if desired, together with antioxidants or stabilisers to prevent decomposition of the reactants. It may frequently be advantageous to carry out the final stages of the condensation at a reduced pressure.

As examples of particular types of polycondensate which are valuable in the process of the present invention, there may be mentioned the polyester condensates containing acidic or water-solvatable groups, which are described in British Pat. Specification No. 1,088,984, in particular the polyester condensates therein described which contain polyoxyethylene groups, and the polyamide condensates containing polyoxyalkylene groups which are described in British Pat. Specification Nos. 1,108,811 and 1,108,812, the polyamide/polyester condensates containing polyoxyalkylene groups which are described in British Pat. Specification No. 1,124,271, and the polyamidealkylene oxide reaction products described in British Pat. Specifications Nos. 799,153 and 907,701.

The present invention can be used in a process for washing or treating fabrics, particularly fabrics based on polyesters and/or polyamides. The invention can also be applied to the washing of other articles.

The hydrophobic repeating group in the soil-release agent is preferably the same as or closely related to the hydrophobic repeating group present in the polymer which the article to be washed or laundered comprises. The affinity of the soil-release agent for the article is thereby increased.

Soil-release agents for which, as indicated above, the invention is particularly advantageous, especially when, as is usual, the detergent composition is added to warm water, are (1) copolymers of polyoxyethylene glycol and polyethylene terephthalate in the range 1:2 to 1:10 as described in more detail in UK Pat. specifications Nos. 1,088,984 and 1,154,730, (2) copolymers of (*i*) polyoxyethylene glycol, (*ii*) adipic acid and (*iii*) hexamethylene diamine or caprolactam or their salts as described in UK Pat. specification No. 1,124,271, and (3) the agents described in U.S. Pat. No. 3,668,000 and, particularly, in NE 7110635. It is extremely unexpected that, as illustrated in Examples 1, 9 and 10, the process of the invention gives such a marked improvement over dry-dosing of these soil-release agents. Note dry-dosing, in contrast to the conventional addition to the slurry, is a very mild method of incorporation.

It will be appreciated that the composition according to the invention will usually contain a surfactant. Surfactants are usually organic extrudable solids and as such are preferred carriers and can form part of the granules, but preferably the composition will comprise the granules and a detergent, suitably for instance in the form of a detergent powder. The term "detergent" is here used to cover surfactants and products containing detergent components other than just surfactants. Except in the preferred forms of the invention, described herein, the nature of the detergent is not important and for the formulation of suitable detergents reference can be made to, for example, Schwartz et al. cited above, Vols. I and II.

When the anti-redeposition agent is a polycondensate containing ester linkages as described in I.C.I. UK Pat. specifications Nos. 1,088,984 and 1,154,730, the detergent is preferably based on a nonionic or on a nonionic and an anionic surfactant. The soil-release effect of such condensates has been found to be reduced when the condensates are incorporated with anionic surfactants. The effect is much less with nonionic surfactants and with mixtures of nonionic and anionic surfactants. Attention should be drawn to copending U.K. Pat. application No. 1,650/71, corresponding to Netherlands Pat. application 7200557, which describes the use of polycondensates, particularly certain polycondensates, described in the above I.C.I. U.K. patent specifications together with certain nonionics. The particular nonionics are:

a. ethoxylated alkyl phenols wherein the total alkyl substituents contain from 6 to 12 carbon atoms, and the ethylene oxide (EO) is present in the molar ratio from 5:1 to 25:1 with reference to the alkyl phenol, and b. condensation products of from 5 to 30 (preferably 5 to 20) molar ratios of ethylene oxide with 1 molar ratio of a straight or branched chain aliphatic, unsaturated or saturated, alcohol containing from 10 to 16 (preferably 12 to 15) carbon atoms or $C_{18}$ (unsaturated), or a branched chain with 18 and 20 carbon atoms.

The preferred nonionic actives are:

octyl phenol condensed with from 5 to 12 EO units, nonyl phenyl condensed with from 5 to 15 EO units, $C_{13}$ secondary alcohols condensed with from 3 to 12 EO units, and $C_{15}$ secondary alcohols condensed with from 5 to 12 EO units.

Detergent formulations of the invention of U.K. Pat. No. 1,650/71 can contain actives other than the nonionic materials defined above.

Other types of active outside the above definition e.g., nonionic, amphoteric or zwitterionic, can be present in relatively large proportion in compositions according to the invention of U.K. Pat. No. 1,650/71 without serious loss of the soil release properties. Thus use of a mixture of nonionic actives, the mixture containing actives both within and outside the above definition, will provide the soil-release properties of the invention. Also, for example, the addition of up to 80%, preferably not more than 40% (by weight of the nonionic active) of dodecyl benzene sulphonate can be tolerated while still obtaining a useful technical effect. Larger proportions of nonionic actives outside the definition can be tolerated.

As mentioned in the complete specification of U.K. Pat. application No. 1,650/71, the use of the agents in granules is preferred in such compositions.

The anti-redeposition agent should preferably form less than 70%, of the granule and should preferably form more than 5% particularly preferably more than 20% of the granule.

Although the granule preferably comprises the anti-redeposition agent and an organic cextrudable solid, the granule can be based on inorganic or on non-extrudable material. Reference should be made to U.K. Pat. specification No. 1,237,899 (Unilever) which describes such granules containing enzymes from which some techniques for use in the present invention will be apparent.

The invention is illustrated by the following Examples. In both the Examples and the above description figures are by weight unless otherwise stated.

EXAMPLE I

A polyethylene terephthalate copolymer was prepared as described in U.K. Pat. specification No. 1,088,984 using a molar ratio of polyethylene terephthalate to polyethylene glycol terephthalate of 7:2 and polyethyleneglycol with an average molecular weight of 1540. The copolymer was dry blended with sodium soap (based on 80% tallow and 20% coconut oil fatty acids) in a weight ratio of 3:7. The blend was milled in a soap mill to disperse the polymer uniformly throughout the soap and then extruded to form granules. A detergent composition containing 3% of granules was prepared by mixing sufficient granules with a spray-dried base formulation of the following composition:

| | | % by weight |
|---|---|---|
| Nonyl phenol 14 EO | | 18 |
| Sodium tripolyphosphate | | 34 |
| Sodium silicate | | 8 |
| Sodium sulphate | | 30 |
| Water | to | 100 |

In the soil-release test described below the product obtained gave a score of 7.

A detergent powder with the same percentage formulation but with the copolymer added to the slurry as an aqueous emulsion to spray-drying gave a score of 3. When the copolymer was added to the base powder as pulverised solid to give the same percentage formulation, the powder obtained gave a score of 3. When an emulsion of the copolymer was sprayed onto the spray-dried base powder to give the same percentage formulation, the powder obtained gave a score of 3.

Soil-release test

Approximately 25 g of bulked polyester fabric (Crimplene) was treated by washing five times in 450 ml of water (hardness of 24° H) at 50° C to which sufficient of the appropriate formulation had been added to form an 0.15% solution. Each wash lasted 10 min. Rinsing and drying occurred between each wash. The washes were carried out in a Launder-O-Meter (Atlas Electrical Devices Co. Chicago). Samples (about 1.5 g) of the treated fabric were stained in a standard manner from a microscopic slide onto which approximately 0.035 g of dirty sump oil (from a car engine) had been evenly applied. After ageing for approximately 15 min, duplicate stained pieces were washed once in 1 l of the same detergent system as in the pre-treatment. After rinsing and drying, the samples were graded visually against standard stains (see p.17 for further explanation.)

An agent can be described as giving a good soil-release effect when, in such a test with the appropriate fabric, a rating of 3, preferably 5 or above is achieved.

EXAMPLES II AND III

The following granules and spray-dried powders were prepared.

Granule A

Soil-release copolymer* (3parts) and soap (7 parts) were milled together and extruded into granules. The soap used was the sodium salt based on 80% tallow and 20% coconut oil fatty acids.

Granule B

Soil-release copolymer* (3 parts) and sodium dodecyl sulphate (7 parts) were milled together and extruded into granules.

Detergent powder A

A spray-dried detergent powder to the following formulation:

| | |
|---|---|
| Active detergent ($C_{15}$ secondary alcohol 9 EO) | 17% |

-continued

| | | |
|---|---|---|
| Soap (tallow based) | | 2% |
| Sodium tripolyphosphate | | 45% |
| Sodium silicate | | 6% |
| Sodium sulphate | | 19% |
| Water | to | 100% |

Detergent powder B

A spray-dried detergent powder to the following formulation:

| | | |
|---|---|---|
| Active detergent ($C_{15}$ secondary alcohol 9 EO) | | 17% |
| Soap (tallow based) | | 2% |
| Sodium tripolyphosphate | | 45% |
| Sodium silicate | | 6% |
| Sodium sulphate | | 19% |
| Soil-release copolymer | | 1% |
| Water | to | 100% |

The following compositions were compounded from the above spray-dried powders and granules and tested by the soil-release test described above.

| | Test score |
|---|---|
| Example 2. Powder A + 3% Granules A | 7 |
| Comparison 1. Powder B + 2% Soap | 1 |
| Example 3. Powder A + 3% Granules B | 7 |
| Comparison 2. Powder B + 2% Sodium dodecyl sulphate | 1 |

EXAMPLES IV AND V

Comparisons were made with powders as described in Example I except that the copolymers contained molar ratios of polyethylene terephthalate to polyethyleneglycol terephthalate of 5:1 and 7:1 respectively. Similar results were obtained in the soil-release test described above.

EXAMPLE VI

Modocol M, a commercial grade of ethyl hydroxyethyl cellulose (3 parts) and soap (7 parts) were milled together and extruded into granules. The soap used was the sodium salt based on 80% tallow and 20% coconut fatty acids.

The two following compositions were compared for anti-redeposition effect by a standard test which involves the washing of clean bulked polyester fabric (Crimplene) together with a standard heavily soiled load using a Terg-O-Tometer washing machine (United States Testing Co. Inc., Hoboken, N.J.). The wash conditions were three repeat washes for 10 min. each at 50° C with 0.15% product concentration in 24° H water. The redeposition was evaluated by measurement of the fabric reflectance using a Hunter reflectometer (green filter).

Product A

A spray-dried detergent powder to the following formulation:

| | | |
|---|---|---|
| Active detergent ($C_{15}$ secondary alcohol 9 EO) | | 17% |
| Soap (tallow based) | | 2% |
| Sodium tripolyphosphate | | 45% |
| Sodium silicate | | 6% |
| Sodium sulphate | | 19% |
| Water | to | 100% |

containing 3% of the above mentioned granules added to the final spray-dried powder.

Product B

The same final formulation as product A but with all of the ingredients added at the slurry stage prior to the spray-drying process.

Anti-redeposition test results

| Anti-redeposition test results | Reflectance % − Difference from Clean Fabric (82%) |
|---|---|
| Product A | −4 |
| Product B | −15 |

EXAMPLE VII

As Example VI but with the copolymer of the type described in U.K. patent specification 1,088,984 (Molar ratio of polyethylene terephthalate to polyethylene glycol terephthalate 7:2. Average molecular weight of polyethylene glycol 1540) instead of the cellulose other derivative.

| Test results | Reflectance % − Difference from Clean Fabric (82%) |
|---|---|
| Product A | −4 |
| Product B | −11 |

EXAMPLE VIII

As Example VII but with an anionic based detergent of the following formulation:

| | | |
|---|---|---|
| Alkylbenzene sulphonate (DOBS 055) | | 25 |
| Sodium tripolyphosphate | | 39 |
| Sodium sulphate | | 11 |
| Sodium silicate | | 12 |
| Water | to | 100 |

Similar results to those given in Example VII were obtained.

EXAMPLE IX

Example VI was repeated except that Product A was compared using the Soil-Release Test given in Example I with a product (Product B) with the same formulation but in which eh Modocol M was added dry to the powder. The following results were obtained:

| | Test Score |
|---|---|
| Product A | 7 |
| Product B | 3 |
| Powder containing no Modocol M | 0 |

The standard stains are prepared by soiling the seven pieces of the appropriate fabric with the dirty sump oil. Rating 0 represents the fully soiled piece, and rating 7 represent the clean fabric and other pieces (1–6) are soiled such that the reflectance values obtained from them using a Hunter Reflectometer (Green filter) are evenly spaced between the values for 0 and 7. For the bulk polyester fibre used in Example 1 the reflectance values for the standard stains with ratings 0 and 7 were 29% and 82% resepctively.

EXAMPLE X

A polyamide polymer was used with the following composition:

| | % |
|---|---|
| Adipic acid | 8.8 |
| Polyoxyethylene glycol (M.wt. 1540) | 45.8 |
| Caprolactam | 35.4 |
| Salt of hexamethylene diamine and Adipic acid (Molar 1:1) | 10 |

A slurry was prepared to which was added the polymer as a 15% aqueous dispersion. Separate samples were spray-dried, one at a slurry-temperature of 20° C and the other of 70°–80° C, to give a detergent powder with the following formulation:

| | | % |
|---|---|---|
| $C_{15}$ secondary alcohol-9-EO'* | | 17 |
| Soap derived from fatty acids from coconut oil | | 3 |
| Sodium tripolyphosphate | | 53 |
| Sodium silicate | | 8 |
| Coconut ethanolamide | | 3 |
| Polymer | | 2 |
| Water | to | 100 |

*The condensation product of 9 moles ethylene oxide with 1 mole of the alcohol.

In the Soil-Release Test described in Example I the following results were obtained:

| Slurry-temp. before spray-drying | Soil-Release Rating |
|---|---|
| 20° C | 3 |
| 70–80° C | 2 |

3parts of the polymer were milled with 7 parts of soap derived from an 80:20 mixture of fatty acids from tallow and coconut oil. The mixture obtained after milling was extruded through fine nozzles to form granules.

The following detergent powder was obtained by adding the granules to the rest of the ingredients already spray-dried.

| | | % |
|---|---|---|
| $C_{15}$ secondary alcohol-9-EO | | 17 |
| Sodium tripolyphosphate | | 53 |
| Sodium silicate | | 8 |
| Coconut ethanolamide | | 3 |
| Granules | | 3 |
| Water | to | 100 |

In the Soil-Release Test described in Example I a rating of 7 was achieved.

What is claimed is:

1. In an improved built laundry detergent composition in powder form including a soil-release agent selected from the group consisting of:

a. a copolymer, in the range of 1:2 to 1:10, of polyoxyethylene glycol and polyethylene terephthalate;

b. a condensation product of (i) polyoxyethylene glycol, (ii) adipic acid and (iii) caprolactam or hexamethylene diamine or its salts of caprolactam or hexamethylene diamine with adipic acid; or c. a cellulose containing an ether-linked, unsubstituted $C_1$ to $C_4$ alkyl group and an ether-linked substituent based on a $C_2$ to $C_4$ hydroxy alkyl group in which the total number of substituent groups per glucose unit of the cellulose is between 1.5 to 3.0, wherein the improvement comprises the incorporation into said detergent composition of said soil release agents in the form of granules, said granules consisting essentially of about 5 to about 70% by weight of said agent dispersed throughout a solid, water soluble, detergent compatible carrier, said carrier being a material other than said soil-release agents.

2. A composition as defined in claim 1 wherein said carrier is an organic solid which is extrudable under conditions of temperature and pressure which will not cause degradation of said soil-release agents.

3. Granules, suitable for inclusion in a laundry detergent formulation, consisting essentially of a solid, water soluble, detergent compatible carrier having dispersed therein about 5 to about 70% by weight of a soil-release agent selected from the group consisting of:

a. a copolymer, in the range of 1:2 to 1:10, of polyoxyethylene glycol and polyethylene terephthalate;

b. a condensation product of (i) polyoxyethylene glycol (ii) adipic acid and (iii) caprolactam or hexamethylene diamine or its salts of caprolactam or hexamethylene diamine with adipic acid; or c. a cellulose containing an ether-linked, unsubstituted $C_1$ or $C_4$ alkyl group and an ether-linked substitutent based on a $C_2$ to $C_4$ hydroxy alkyl group in which the total number of substituent groups per glucose unit of the cellulose is between 1.5 and 3.0, said carrier being a material other than said soil-release agent.

* * * * *